US008291737B2

(12) United States Patent
Huang et al.

(10) Patent No.: US 8,291,737 B2
(45) Date of Patent: Oct. 23, 2012

(54) AUTOMATIC EXTRUSION DEVICE

(75) Inventors: Roger Huang, Wurih Township, Taichung County (TW); Newer Wang, Wurih Township, Taichung County (TW); George Chang, Wurih Township, Taichung County (TW); Jason Liao, Wurih Township, Taichung County (TW)

(73) Assignee: Maxclaw Tools Co., Ltd., Majuro (MH)

( * ) Notice: Subject to any disclaimer, the term of this patent is extended or adjusted under 35 U.S.C. 154(b) by 365 days.

(21) Appl. No.: 12/763,157

(22) Filed: Apr. 19, 2010

(65) Prior Publication Data

US 2011/0192207 A1 Aug. 11, 2011

(30) Foreign Application Priority Data

Feb. 11, 2010 (TW) ..... 99203051 U

(51) Int. Cl.
*B21D 41/02* (2006.01)

(52) U.S. Cl. ..... 72/120

(58) Field of Classification Search ..... 72/112–126, 72/317

See application file for complete search history.

(56) References Cited

U.S. PATENT DOCUMENTS 5,956,987 A * 9/1999 Anthoine ..... 72/21.5
6,016,678 A * 1/2000 Diller ..... 72/119

* cited by examiner

*Primary Examiner* — Faye Francis

(57) ABSTRACT

An automatic extrusion device includes a main body, a driving unit, a first transmission unit, a second transmission unit and an extrusion unit. The second transmission unit has a clutch slip function for the automatic extrusion device to extrude the front of the pipe to be in the form of a bell for a fast connection of pipes. Through the slip function of the second transmission unit, it not only prevents the extrusion unit from over extrusion but also makes the front end of the pipe round so as to beautify the interface of the pipe.

13 Claims, 11 Drawing Sheets

AUTOMATIC EXTRUSION DEVICE

BACKGROUND OF THE INVENTION

1. Field of the Invention

The present invention relates to an automatic extrusion device.

2. Description of the Prior Art

A metallic pipe has the properties of heat resistance, pressure resistance and good conductivity, so it is widely used in refrigeration plumbing, air condition plumbing, hot water pipe system or the like. When the length of the metallic pipe is not enough or the metallic pipe needs a turning, the user uses an extrusion device to extrude one end of the pipe to be in the form of a bell for connecting with another metallic pipe. The conventional extrusion device is operated manually, which consumes time and labor. In general, the metallic pipe is installed in a hidden position. It is not convenient for the user to proceed with the connection of the pipes. When there are quantities of pipe connections, the user will have a difficult task. Accordingly, the inventor of the present invention has devoted himself based on his many years of practical experiences to develop an automatic compulsion device.

SUMMARY OF THE INVENTION

The present invention is to provide an automatic extrusion device which comprises a main body, a driving unit, a first transmission unit, a second transmission unit and an extrusion unit. The main body has an accommodating room therein. The driving unit is disposed in the accommodating room for supplying power. The first transmission unit is disposed in the accommodating room and connected with the driving unit for receiving the power from the driving unit. The second transmission unit is disposed in the accommodating room. The second transmission unit comprises an inner threaded pipe, an outer threaded pipe, an action sleeve and a driving member. The inner threaded pipe is fixed in the accommodating room. One end of the outer threaded pipe has an engaging portion. The engaging portion is screwed in the inner threaded pipe. Another end of the outer threaded pipe extends out the inner threaded pipe and is formed with a stop portion. One end of the action sleeve has a connection portion to connect with the first transmission unit. Another end of the action sleeve is formed with a head. The driving member is disposed between the stop portion of the outer threaded pipe and the head of the action sleeve. The action sleeve transmits the power to the outer threaded pipe for driving the outer threaded pipe to turn in the inner threaded pipe. One end of the driving member has a slip inclined surface. Another end of the driving member has a press portion. The press portion is adapted to press an elastic member which is axially provided. The slip inclined surface of the driving member provides a slip effect when the outer threaded pipe stops running. The extrusion unit has a center shaft. One end of the center shaft has a fixing portion. The fixing portion is inserted through the inner threaded pipe and the outer threaded pipe and connected to the action sleeve. Another end of the center shaft has a coupling portion. A front end of the coupling portion is connected with a mandrel assembly. The automatic extrusion device extrudes the front end of the pipe to be in the form of a bell through the mandrel assembly. In this way, the user can extrude the pipe quickly to save time and labor for a fast connection of pipes. Through the slip inclined surface, the present invention can prevent the extrusion unit from over extrusion. The mandrel assembly can be turned continually to make the front end of the pipe round so as to beautify the interface of the pipe.

DETAILED DESCRIPTION OF THE PREFERRED EMBODIMENTS

Embodiments of the present invention will now be described, by way of example only, with reference to the accompanying drawings.

Figure 1:
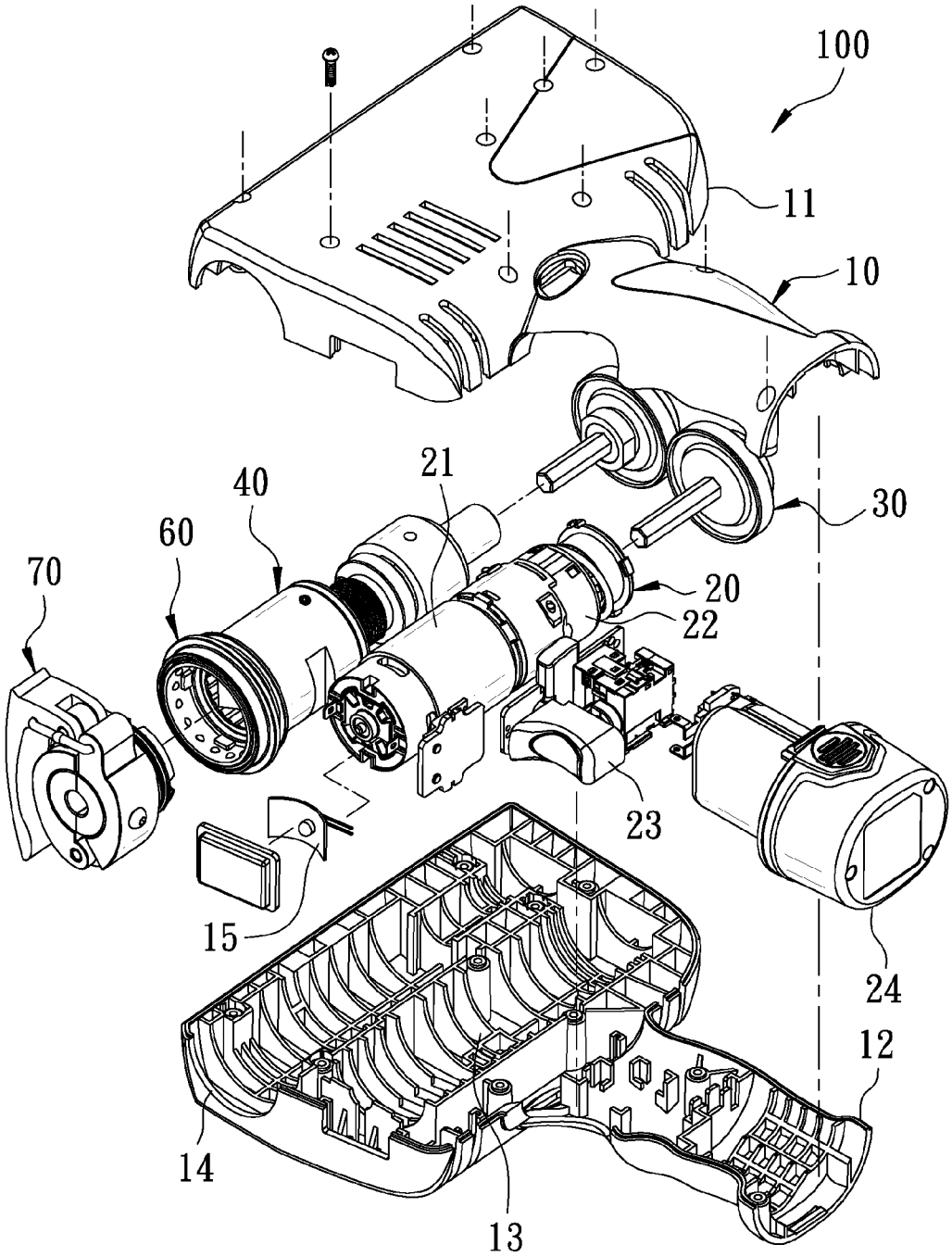
FIG. 1 is an exploded view according to a preferred embodiment of the present invention.
Figure 2:
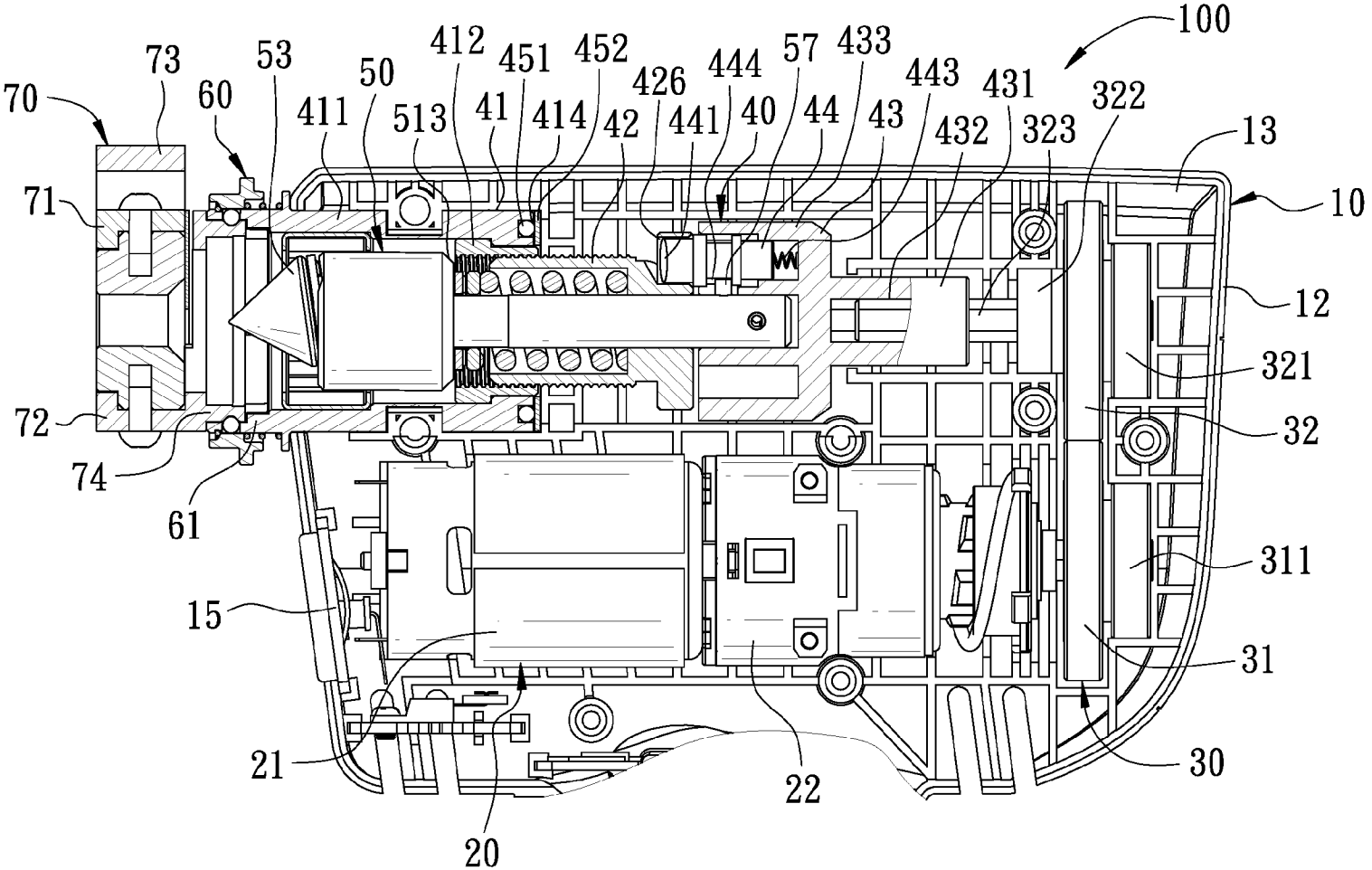
FIG. 2 is a partially cross-sectional view according to the preferred embodiment of the present invention.
Figure 3:
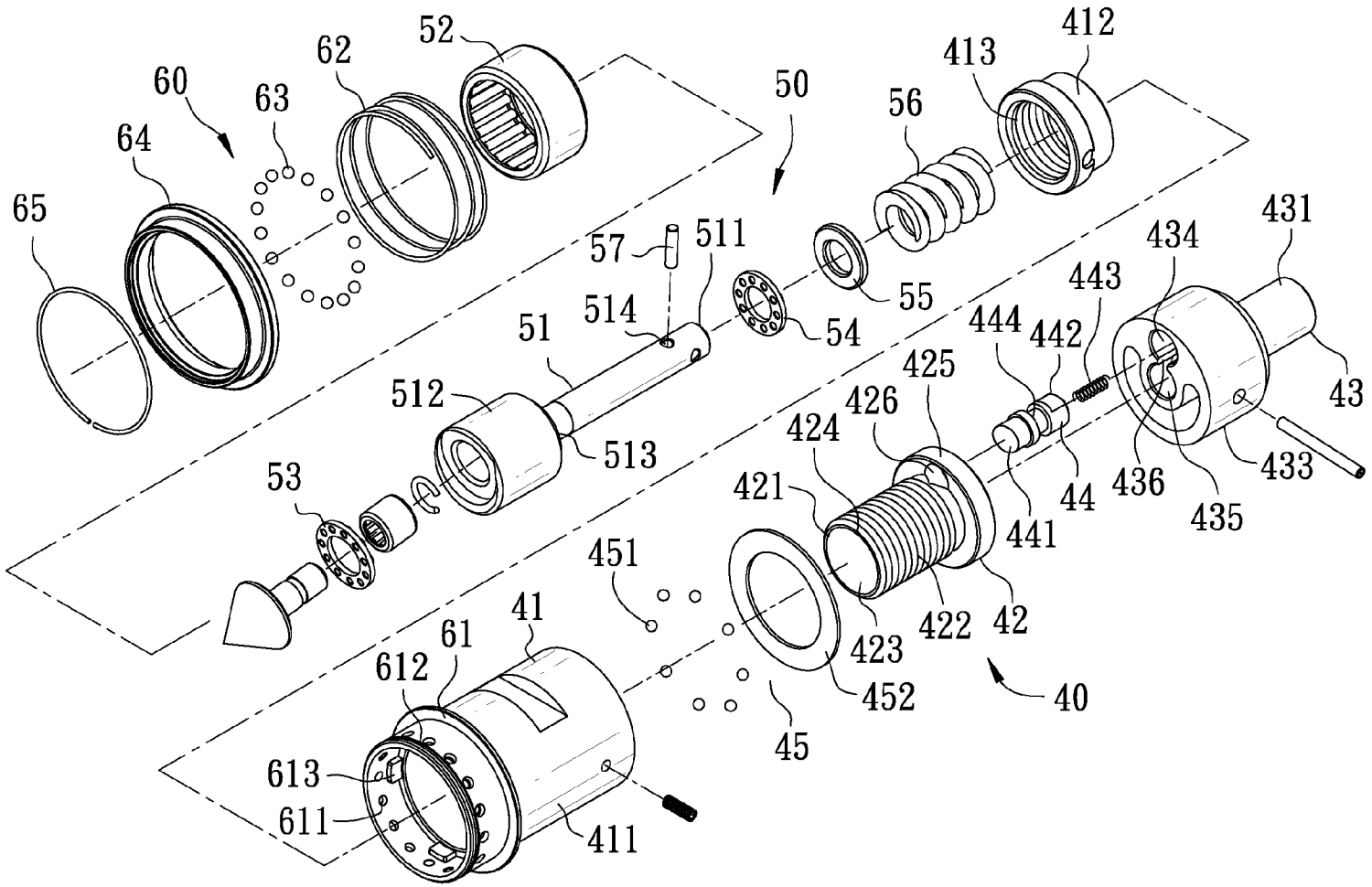
FIG. 3 is an exploded view of the second transmission unit of the present invention.

As shown in FIG. 1 to FIG. 3, an automatic extrusion device 100 according to a first preferred embodiment of the present invention comprises a main body 10, a driving unit 20, a first transmission unit 30, and a second transmission unit 40.

The main body 10 is composed of an upper casing 11 and a lower casing 12. The main body 10 has an accommodating room 13 between the upper casing 11 and the lower casing 12 and an opening 14 at a front end thereof. The opening 14 communicates with the accommodating room 13. A lighting unit 15 is provided at the front end of the main body 10 close to the opening 14. The lighting unit 15 is a light bulb or a light emitting diode.

The driving unit 20 is disposed in the accommodating room 13 for supplying power. The driving unit 20 comprises a motor 21. A front end of the motor 21 is connected with a deceleration machine 22 for reducing the rotational speed of the motor 21. A rear end of the motor 21 is connected with a control unit 23 to turn on/off the motor 21. The control unit 23 is further connected with a battery 24 for supplying power to the motor 21.

The first transmission unit 30 is disposed in the accommodating room 13 and connected with the driving unit 20 for receiving the power from the driving unit 20. In this embodiment, the first transmission unit 30 comprises a driving gear 31 and a driven gear 32. One end of the driving gear 31 is connected to the driving unit 20, and another end of the driving gear 31 is fixed in the accommodating room 13 of the main body 10 through a first ball bearing 311. Two ends of the driven gear 32 are connected with a second ball bearing 321 and a copper bearing 322, such that the driven gear 32 is positioned next to the driving gear 31 to engage with the driving gear 31. One side of the copper bearing 322 of the driven gear 32 is connected with a driving shaft 323.

The second transmission unit 40 is disposed in the accommodating room 13, and comprises an inner threaded pipe 41, an outer threaded pipe 42, an action sleeve 43, a driving member 44, and a thrust assembly 45.

The inner threaded pipe 41 is fixed in the accommodating room 13 and located close to the opening 14. In this embodiment, the inner treaded pipe 41 comprises an outer pipe body 411 and an inner threaded ring 412 in the outer pipe body 411. The inside of the inner threaded ring 412 is formed with inner threads 413.

One end of the outer threaded pipe 42 has an engaging portion 421. The engaging portion 421 has outer threads 422 thereon to be screwed in the inner threaded ring 412 of the inner threaded pipe 41. The engaging portion 421 has one end formed with a circular trough 423 and a first inclined surface 424 around the circular trough 423. Another end of the outer threaded pipe 42 extends out the inner threaded pipe 41 and is formed with an enlarged stop portion 425. The stop portion 425 is axially formed with an insertion trough 426 which is located close to an outer edge of the stop portion 425.

The action sleeve 43 is disposed adjacent to the outer threaded pipe 42. One end of the action sleeve 43 has a connection portion 431. The connection portion 431 is axially formed with a connection trough 432 for connecting with the driving shaft 323 of the first transmission unit 30. Another end of the action sleeve 43 is formed with an enlarged head 433. The head 433 has an end formed with a recess 434 corresponding to the insertion trough 426 of the outer threaded pipe 42.

The driving member 44 is disposed between the stop portion 425 of the outer threaded pipe 42 and the head 433 of the action sleeve 43, so that the action sleeve 43 can transmit the power to the outer threaded pipe 4 for driving the outer threaded pipe 42 to turn in the inner threaded pipe 41. One end of the driving member 44 has a slip inclined surface 441, and another end of the driving member 44 has a press portion 442. The press portion 442 is adapted to press an elastic member 443 which is axially provided. The slip inclined surface 441 of the driving member 44 will provide a slip effect when the outer threaded pipe 42 stops running. In this embodiment, the elastic member 443 and the press portion 442 of the driving member 44 are inserted into the recess 434 of the action sleeve 43 in sequence. The end having the slip inclined surface 441 of the driving member 44 is extended out the recess 434 and inserted into the insertion trough 426 of the outer threaded pipe 42.

The thrust assembly 45 is disposed between the inner threaded pipe 41 and the stop portion 425 of the outer threaded pipe 42. The thrust assembly 45 comprises a plurality of steel balls 451 and an annular washer 452. In this embodiment, the inner threaded pipe 41 has one end which faces the stop portion 425 and has a plurality of holes 414 to accommodate the steel balls 451. The annular washer 452 is disposed outside the holes 414.

Referring to FIG. 2 and FIG. 3, the automatic extrusion device 100 further comprises an extrusion unit 50. The extrusion unit 50 has a center shaft 51. One end of the center shaft 51 has a fixing portion 511. The fixing portion 511 is inserted through the inner threaded pipe 41 and the outer threaded pipe 42 and connected to the action sleeve 43. Another end of the center shaft 51 has an enlarged coupling portion 512. A needle bearing 52 is fitted on the coupling portion 512. A front end of the coupling portion 512 is connected with a mandrel assembly 53. A second inclined surface 513 is formed between the center shaft 51 and the coupling portion 512 for reducing the friction between the coupling portion 512 and the inner threaded ring 412. A ball washer 54, a packing 55 and a spring 56 are provided on the center shaft 51 and accommodated in the circular trough 423 of the outer threaded pipe 42. The spring 56 urges the ball washer 54 to lean against the coupling portion 512 of the center shaft 51.

The driving member 44 has an annular limit groove 444 thereon. The head 433 of the action sleeve 43 has a coupling trough 435 at a central portion thereof for the fixing portion 511 of the center shaft 51 to be secured therein. An inner wall of the coupling trough 345 of the action sleeve 43 has a limit trough 436 which corresponds to the annular limit trough 444 and communicates with the recess 434. The fixing portion 511 of the center shaft 51 has a limit hole 514 thereon. The limit hole 514 corresponds to the limit trough 436 and is adapted to receive a limit pin 57 therein. One end of the limit pin 57 extends out the limit hole 514 and inserts through the limit trough 436 to be located in the annular limit through 444, such that the driving member 44 is confined in the recess 434.

Figure 4:
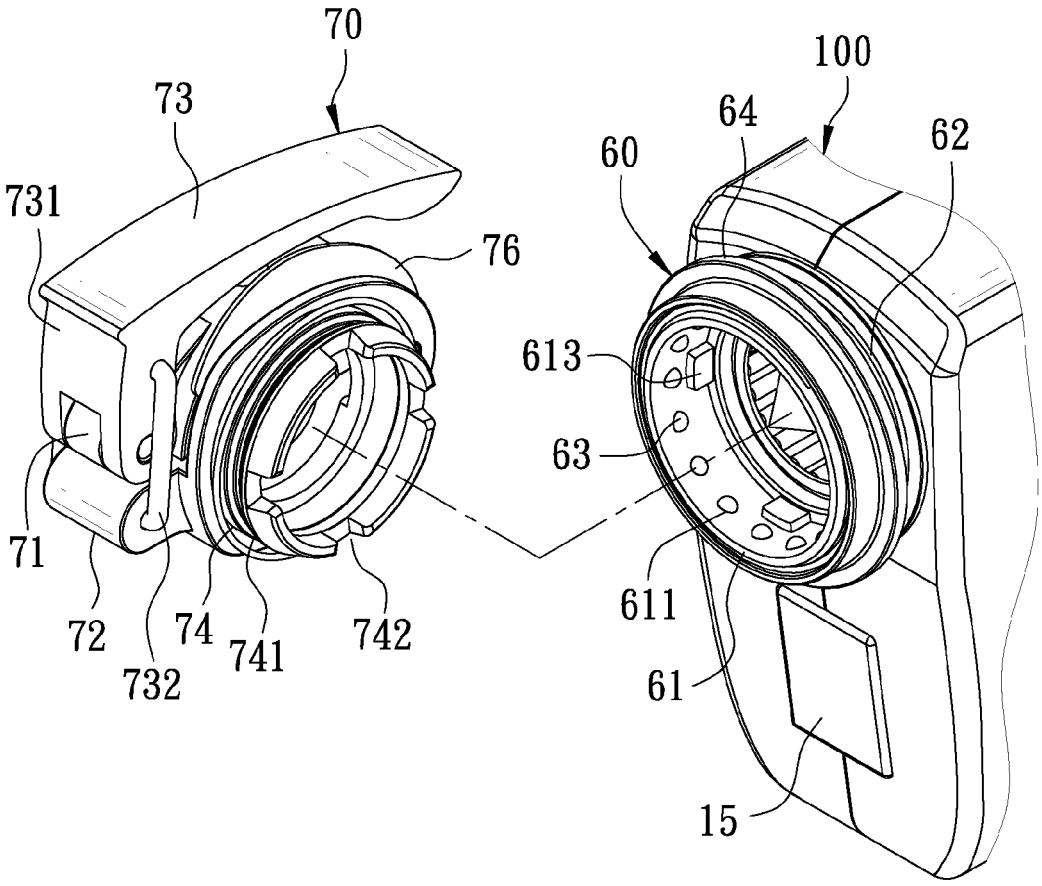
FIG. 4 is a partially enlarged and exploded view according to the preferred embodiment of the present invention.
Figure 6:
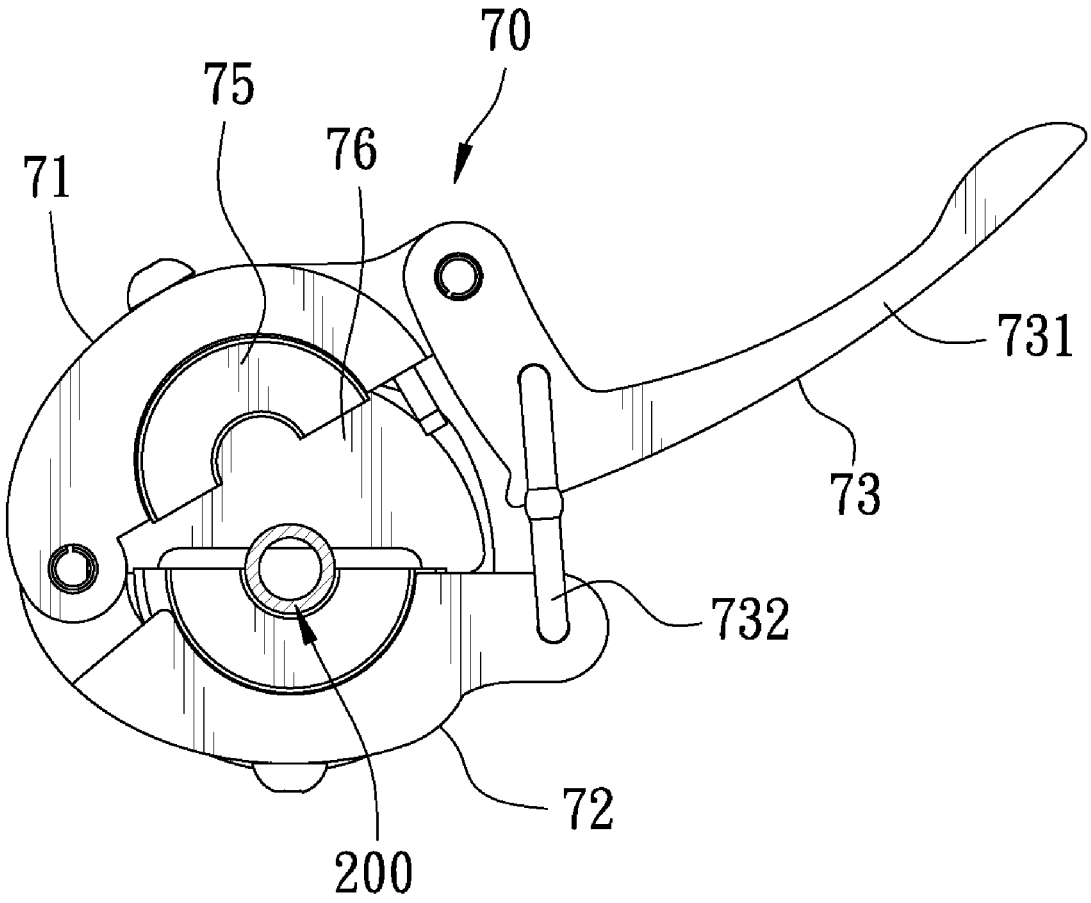
FIG. 6 is a schematic view showing the operation of the clamping unit of the present invention.

FIG. 4 is a partially enlarged view of the first preferred embodiment of the present invention. The automatic extrusion device 100 further comprises a quick-release unit 60 which is located at one end of the inner threaded pipe 41, opposite to the outer threaded pipe 42. The quick-release unit 60 is further connected with a clamping unit 70. The quick-release unit 60 comprises an annular quick-release seat 61. In this embodiment, the quick-release seat 61 is integrally formed with the inner threaded pipe 41. The quick-release seat 61 has an annular inside formed with a plurality of through holes 611 and an annular fixing groove 612. The inside of the quick-release seat 61 is provided with a plurality of positioning protrusions 613. A spring 62, a plurality of steel balls 63 received in the through holes 611, a tightening ring 64 and a C-shaped ring 65 received in the annular fixing trough 612 are provided on the quick-release seat 61. The clamping unit 70 comprises an upper clamping seat 71 and a lower clamping seat 72. First ends of the upper clamping seat 71 and the lower clamping seat 72 are pivotally connected together, and second ends of the upper clamping seat 71 and the lower clamping seat 72 are connected with a connecting member 73. The connecting member 73 is composed of a press handle 731 and a buckling ring 732. One side of the clamping unit 70 has a protruding ring 74 corresponding to the quick-release seat 61. An annular side of the protruding ring 74 has a positioning groove 741 corresponding to the steel balls 63 of the quick-release unit 60. A distal end of the protruding ring 74 has a plurality of notches 742 corresponding to the positioning protrusions 613 for the protruding ring 74 to be positioned on the quick-release seat 61. Referring to FIG. 6, the clamping unit 70 further has a clamping portion 75 which is disposed between the upper clamping seat 71 and the lower clamping seat 72 and a stop plate 76 which is disposed between the clamping portion 75 and the positioning groove 741.

Figure 5:
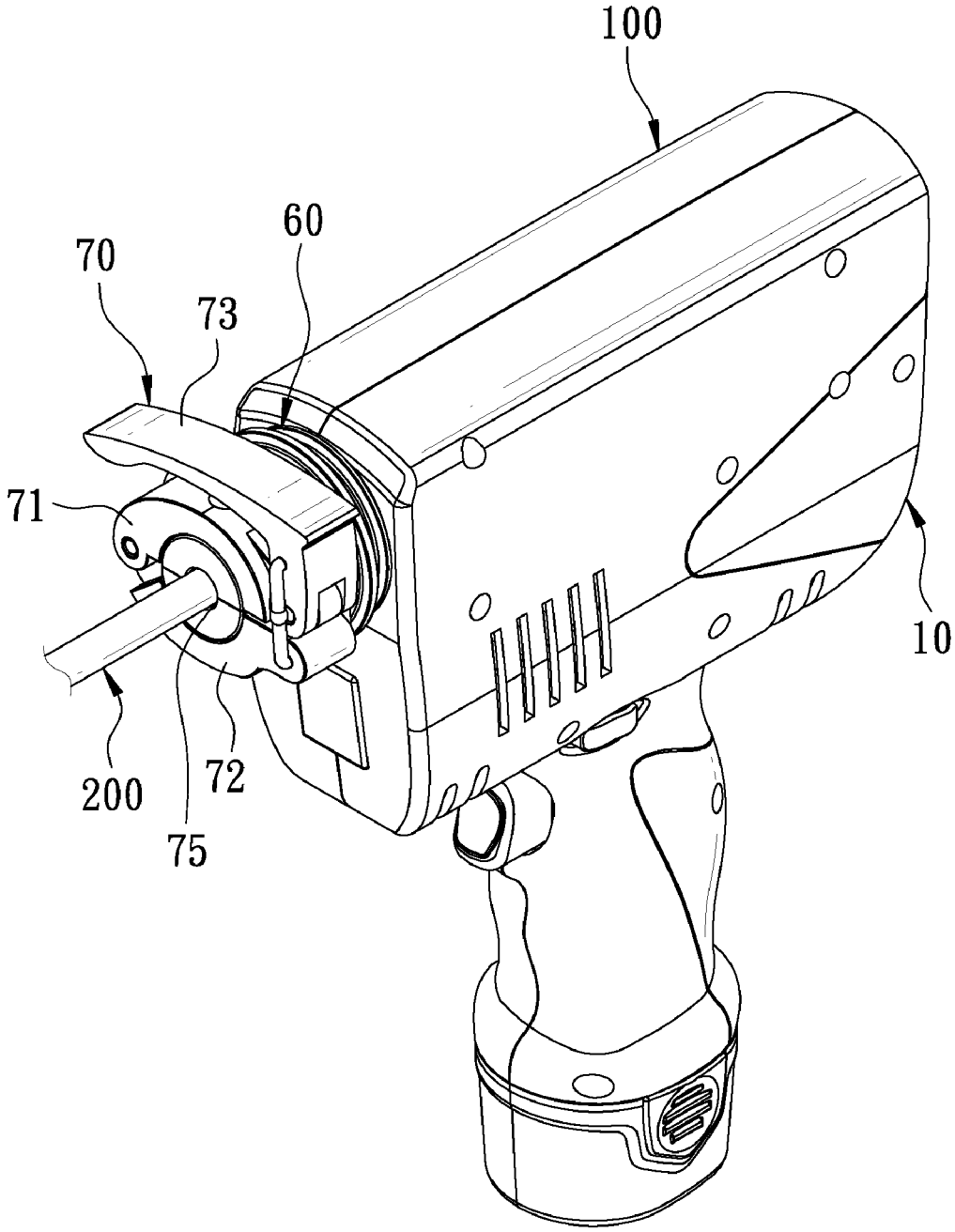
FIG. 5 is a schematic view showing the preferred embodiment of the present invention when in use.

FIG. 5 is a schematic view of the first preferred embodiment of the present invention when in use. When the user uses the automatic extrusion device 100 to extrude a pipe 200, the pipe 200 is first clamped on the clamping unit 70 and assembled on the automatic extrusion device 100 though the quick-release unit 60. As shown in FIG. 6, the press handle 731 of the clamping unit 70 is turned counterclockwise to separate the upper clamping seat 71 and the lower clamping seat 72, so that the pipe 200 is placed in the clamping portion 75. The front of the pipe 200 is stopped by the stop plate 76 to position the extrusion depth, and then the press handle 731 is turned in an opposite direction to buckle the upper clamping seat 71 and the lower clamping seat 72 together through the buckling ring 732, such that the pipe 200 is clamped on the clamping unit 70 securely.

Figure 7:
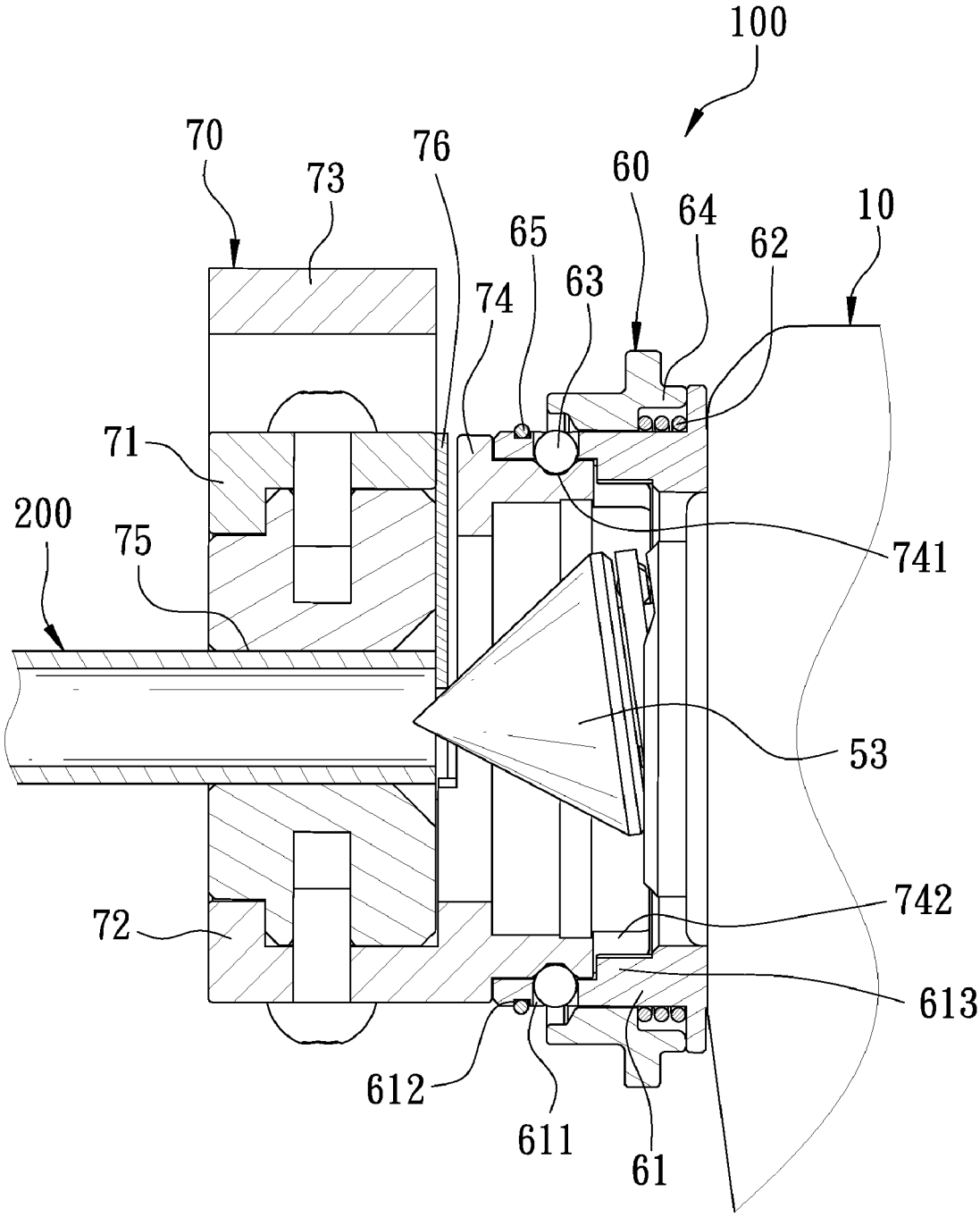
FIG. 7 is a schematic view showing the operation of the quick-release unit of the present invention.
Figure 8:
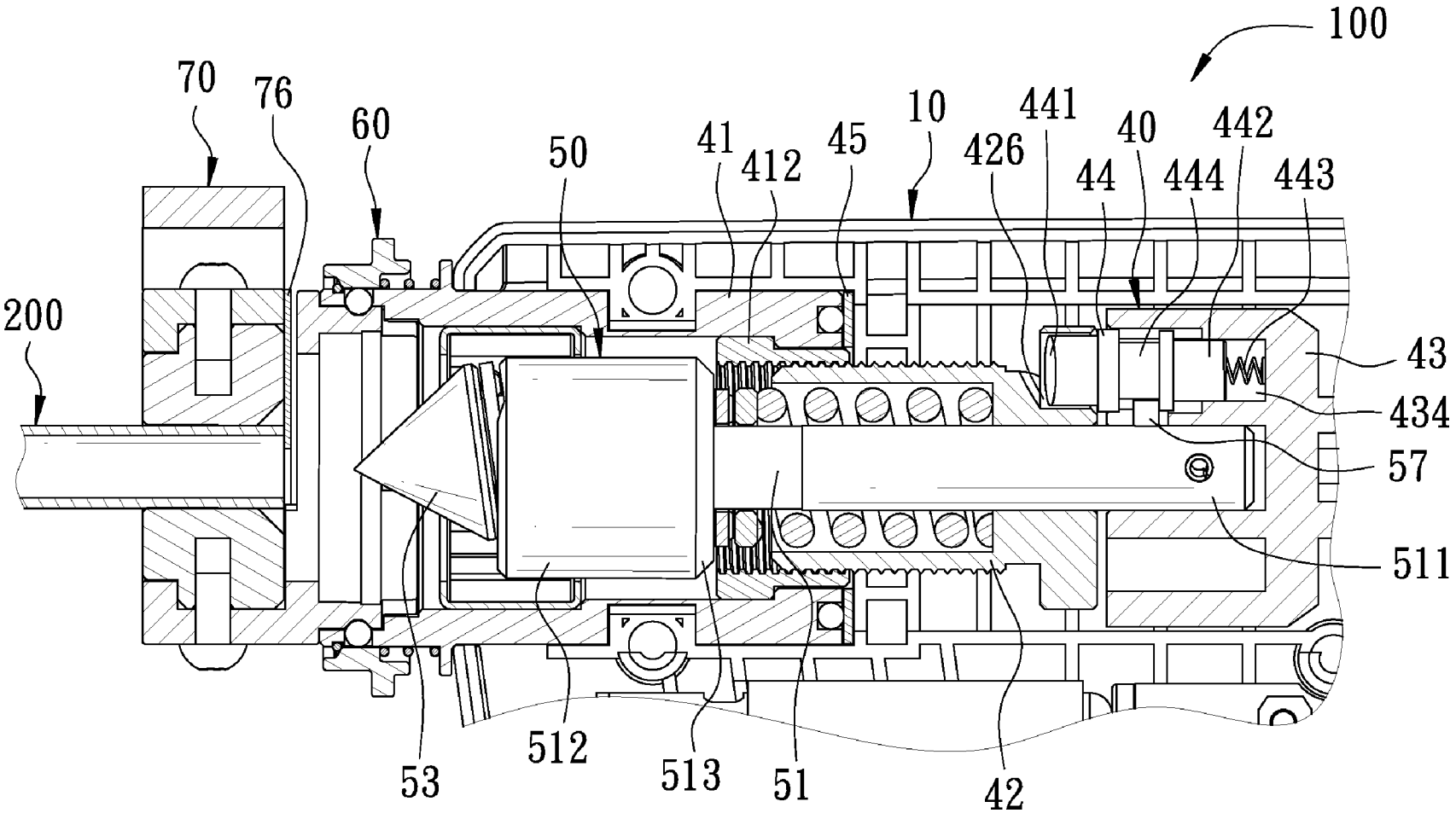
FIG. 8 is a schematic view of the second transmission unit of the present invention to show the driving member before slip.

Referring to FIG. 5, after the pipe 200 is clamped on the clamping unit 70, the clamping unit 70 is secured on the automatic extrusion device 100 through the quick-release unit 60. As shown in FIG. 7, the tightening ring 64 is pushed toward the automatic extrusion device 100 to move the steel balls 63 toward the outside of the through holes 611, and then the protruding ring 74 of the clamping unit 70 is inserted in the quick-release seat 61 of the quick-release unit 60 with the notches 742 to engage with the positioning protrusions 613 to finish the limitation of the turning direction. Finally, the tightening ring 64 is released, so that the tightening ring 64 is pushed by the spring 62 to move toward the clamping unit 70, as shown in FIG. 8, and stopped by C-shaped ring 65 to compress the steel balls 63. The steel balls 63 are engaged in the positioning groove 741 of the clamping unit 70, so that the clamping unit 70 is coupled with the quick-release unit 60.

Figure 9:
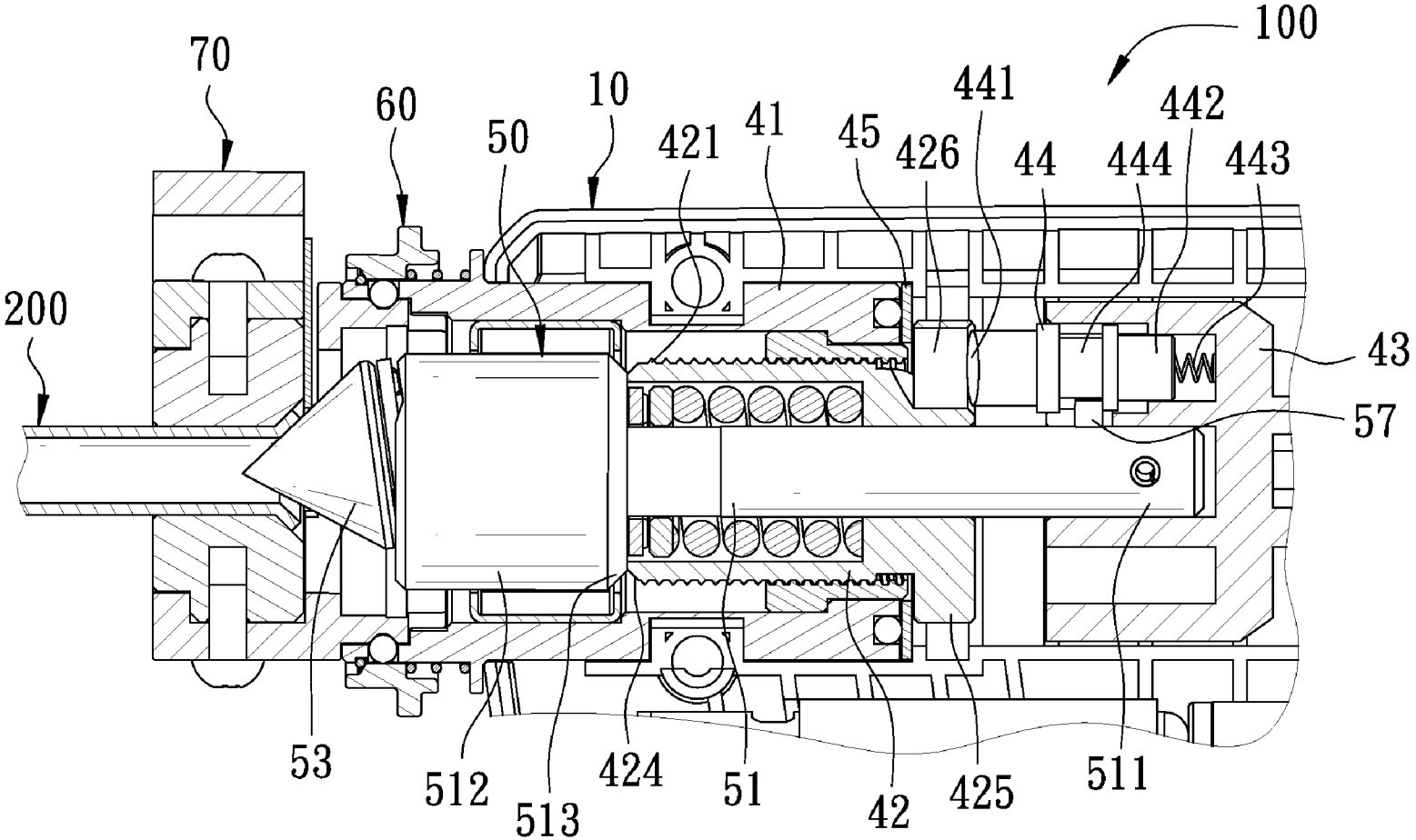
FIG. 9 is a schematic view of the second transmission unit of the present invention to show the driving member in a slip status.
Figure 10:
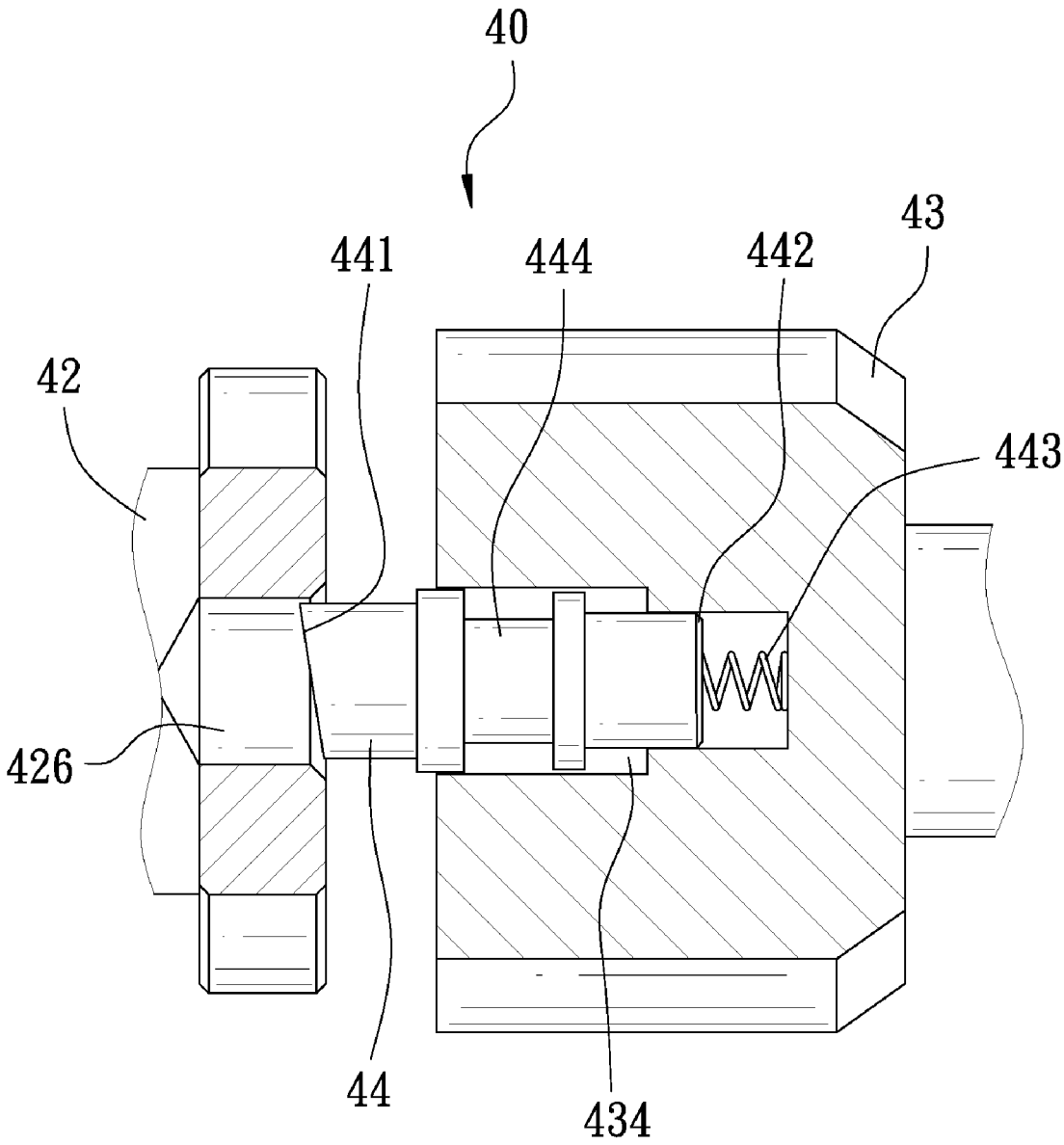
FIG. 10 is another schematic view to show the second transmission unit of the present invention.

FIG. 8 and FIG. 9 show the operation of the second transmission unit according to the first preferred embodiment of the present invention. When the pipe 200 is clamped on the clamping unit 70 and the clamping unit 70 is mounted on the automatic extrusion device 100 through the quick-release unit 60, the automatic extrusion device 100 can be started to turn the action sleeve 43. The outer threaded pipe 42 is turned in the inner threaded pipe 41 through the driving member 44 to move toward the coupling portion 512 of the center shaft 51, and the center shaft 51 is pushed toward the clamping unit 70. The mandrel assembly 53 is moved forward through the stop plate 76 to lean against the front end of the pipe 200 for extruding the front end of the pipe 200 to be in the form of a bell, as shown in FIG. 9. In this way, the user can extrude the pipe 200 quickly for a fast connection of pipes. As shown in FIG. 9, the engaging portion 421 of the outer threaded pipe 42 holds against the coupling portion 512 of the center shaft 51, and the first inclined surface 424 and the second inclined surface 513 can reduce their contact area to lower the friction and abrasion. As shown in FIG. 10, when the extrusion unit 50 is pushed to the terminal and the outer threaded pipe 42 is stopped, the driving member 44 will be guided by the slip inclined surface 441 to disengage from the insertion trough 426 and to move toward the recess 434 causing a slip effect to prevent it from over extrusion. The center shaft 51 is connected to the action sleeve 43 through the fixing portion 511. The center shaft 51 still drives the mandrel assembly 53 to turn for making the front end of the pipe 200 round while the driving member 44 is slipped. In addition, when the user finishes the extrusion procedure and wants to retreat the extrusion unit 50, the action sleeve 43 will be turned in an opposite direction. Because the slip inclined surface 411 of the driving member 44 is located opposite to the turning direction, the driving member 44 is pushed by the elastic member 443 to insert into the insertion trough 426 again and the outer threaded pipe 42 is screwed to retreat from the inner threaded pipe 41. The thrust assembly 45 located between the inner threaded pipe 41 and the stop portion 425 of the outer threaded pipe 42 can reduce the friction, so that the driving member 44 can screw the outer threaded pipe 42 with ease to retreat the extrusion unit 50 from the clamping unit 70.

Figure 11:
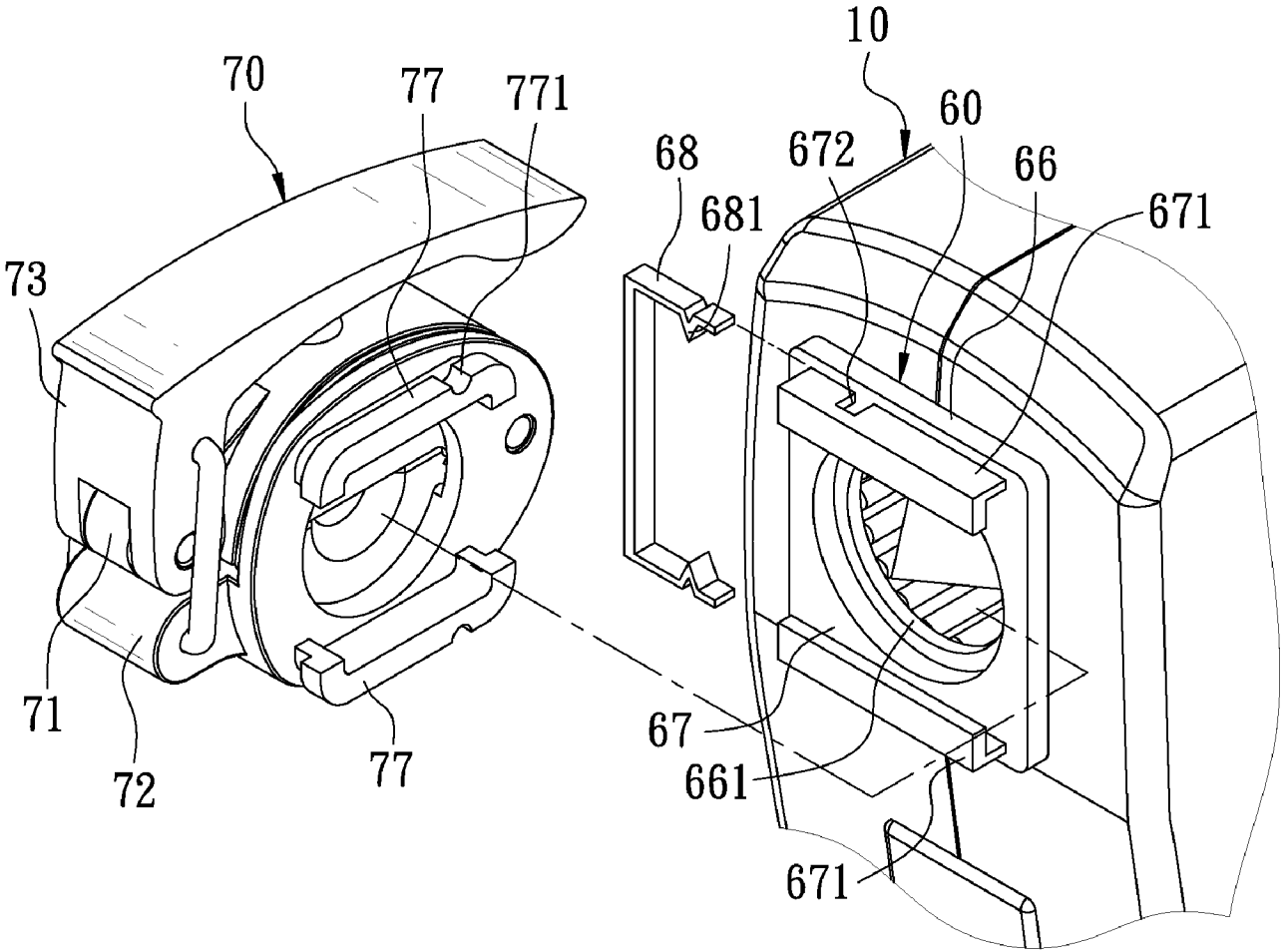
FIG. 11 is a partially enlarged and exploded view according to another preferred embodiment of the present invention.

FIG. 11 is a partially enlarged view according to a second embodiment of the present invention, which is substantially similar to the first embodiment with the exceptions described hereinafter. The quick-release unit 60 has a quick-release seat 66 in the form of a board. The quick-release seat 66 has a circular hole 661 at a central portion thereof and a guide trough 67 at one side thereof. The guide trough 67 has two side walls 671. Each of the side walls 671 has a through hole 672 thereon. The quick-release unit 60 further comprises a locking member 68 which is transversely located at one end of the guide trough 67. The locking member 68 has two ends each formed with a curved portion 681 to be inserted through the through hole 672 and slightly exposed out of the through hole 672. The clamping portion 75 of the clamping unit 70 is provided with a pair of slide blocks 77 corresponding to the guide trough 67. Each of the slide blocks 77 has a positioning concave 771 corresponding to the through hole 672. The clamping unit 70 is slid in the guide trough 67 with the curved portion 681 of the locking member 68 at one end of the guide trough 67 to engage with the positioning concave 771, so that the clamping unit 70 is secured on quick-release unit 60 quickly, having the same effect of quick assembly as the first embodiment.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. An automatic extrusion device, comprising:

a main body having an accommodating room therein;

a driving unit disposed in the accommodating room for supplying power;

a first transmission unit disposed in the accommodating room and connected with the driving unit for receiving the power from the driving unit;

a second transmission unit disposed in the accommodating room, the second transmission unit comprising an inner threaded pipe, an outer threaded pipe, an action sleeve and a driving member, the inner threaded pipe being fixed in the accommodating room, one end of the outer threaded pipe having an engaging portion, the engaging portion being screwed in the inner threaded pipe, another end of the outer threaded pipe extending out the inner threaded pipe and being formed with a stop portion, one end of the action sleeve having a connection portion to connect with the first transmission unit, another end of the action sleeve being formed with a head, the driving member being disposed between the stop portion of the outer threaded pipe and the head of the action sleeve, the action sleeve transmitting the power to the outer threaded pipe for driving the outer threaded pipe to turn in the inner threaded pipe, one end of the driving member having a slip inclined surface, another end of the driving member having a press portion, the press portion being adapted to press an elastic member which is axially provided, the slip inclined surface of the driving member providing a slip effect when the outer threaded pipe stops running; and an extrusion unit having a center shaft, one end of the center shaft having a fixing portion, the fixing portion being inserted through the inner threaded pipe and the outer threaded pipe and connected to the action sleeve, another end of the center shaft having a coupling portion, a front end of the coupling portion being connected with a mandrel assembly.

2. The automatic extrusion device as claimed in claim 1, wherein the stop portion of the outer threaded pipe is axially formed with an insertion trough which is located close to an outer edge of the stop portion, the head of the action sleeve having a front end formed with a recess corresponding to the insertion trough, the elastic member and the driving member being inserted into the recess in sequence, the end having the slip inclined surface of the driving member being extended out the recess and inserted into the insertion trough.

3. The automatic extrusion device as claimed in claim 2, wherein the driving member has an annular limit groove thereon, the head of the action sleeve having a coupling trough at a central portion thereof, an inner wall of the coupling trough of the action sleeve having a limit trough which corresponds to the annular limit trough and communicates with the recess, the fixing portion of the center shaft having a limit hole thereon, the limit hole corresponding to the limit trough and being adapted to receive a limit pin therein, one end of the limit pin extending out the limit hole and inserting through the limit trough to be located in the annular limit through, the driving member being confined in the recess.

4. The automatic extrusion device as claimed in claim 1, wherein the inner threaded pipe has one end which faces the stop portion of the outer threaded pipe and has a plurality of holes, the second transmission unit further comprising a thrust assembly, the thrust assembly comprising a plurality of steel balls received in the holes and an annular washer disposed outside the holes.

5. The automatic extrusion device as claimed in claim 1, wherein the inner treaded pipe comprises an outer pipe body and an inner threaded ring disposed in the outer pipe body.

6. The automatic extrusion device as claimed in claim 1, wherein the engaging portion of the outer threaded pipe has a circular trough to accommodate a ball washer, a packing and a spring, the spring urging the ball washer to lean against the coupling portion of the center shaft.

7. The automatic extrusion device as claimed in claim 1, wherein the end of the engaging portion of the outer threaded pipe has a first inclined surface.

8. The automatic extrusion device as claimed in claim 1, wherein a second inclined surface is formed between the center shaft and the coupling portion.

9. The automatic extrusion device as claimed in claim 1, wherein the driving unit comprises a motor, the motor being connected with a deceleration machine, the deceleration machine being further connected with the first transmission unit.

10. The automatic extrusion device as claimed in claim 1, wherein the first transmission unit comprises a driving gear and a driven gear, one end of the driving gear being connected to the driving unit, another end of the driving gear being fixed in the accommodating room of the main body through a first ball bearing, two ends of the driven gear being connected with a second ball bearing and a copper bearing, the driven gear being positioned next to the driving gear to engage with the driving gear, one side of the copper bearing of the driven gear being connected with a driving shaft, the driving shaft being connected to the action sleeve.

11. The automatic extrusion device as claimed in claim 1, wherein a quick-release unit is provided at one end of the inner threaded pipe opposite to the outer threaded pipe, the quick-release unit being further connected with a clamping unit.

12. The automatic extrusion device as claimed in claim 11, wherein the quick-release unit comprises an annular quick-release seat, the quick-release seat having an annular inside formed with a plurality of through holes and an annular fixing groove, the inside of the quick-release seat being provided with a plurality of positioning protrusions, the quick-release seat further comprising a spring, a plurality of steel balls received in the through holes, a tightening ring and a C-shaped ring received in the annular fixing trough, one side of the clamping unit having a protruding ring corresponding to the quick-release seat, an annular side of the protruding ring having a positioning groove corresponding to the steel balls of the quick-release unit, a distal end of the protruding ring having a plurality of notches corresponding to the positioning protrusions for the protruding ring to be positioned on the quick-release seat.

13. The automatic extrusion device as claimed in claim 1, wherein a lighting unit is provided at a front end of the main body.

* * * * *